United States Patent [19]

Connon, Jr.

[11] 4,002,250

[45] Jan. 11, 1977

[54] AUTOMATIC UNLOADING METAL PICKLING RACK

[76] Inventor: Frederick L. Connon, Jr., P.O. Box 88, Erieau, Ontario, Canada, N0P 1N0

[22] Filed: Mar. 10, 1976

[21] Appl. No.: 665,640

[52] U.S. Cl. ..... 214/8; 206/449; 211/50; 214/10.5 R; 271/207; 294/67 R

[51] Int. Cl.[2] ..... B65G 57/03

[58] Field of Search ..... 214/1 S, 6 N, 8, 10.5 R; 271/207; 294/67 R; 134/137; 211/49 R, 50; 206/449, 454

[56] References Cited

UNITED STATES PATENTS

| | | | |
|---|---|---|---|
| 1,283,871 | 11/1918 | Nichols | 214/10.5 R |
| 1,753,933 | 4/1930 | Lormor | 214/7 X |
| 2,168,205 | 8/1939 | Harten et al. | 214/1 S X |
| 2,247,519 | 7/1941 | Pace | 214/10.5 R X |

*Primary Examiner*—L. J. Paperner
*Attorney, Agent, or Firm*—Charles Krassov

[57] ABSTRACT

This invention consists of a metal plate pickling rack which eliminates manual handling at several stages of the pickling operation, and provides a safety factor for the operator against contact with the pickling acid. The rack consists of an acid resisting metal rack in which the plates are contained in two opposite piles. The plates are spaced from each other, are supported at their bottom edges by alternately spaced notches in the opposite walls of the rack, and are supported at their top edges by leaning against a pair of removable rods centrally located in the rack. When the entire pickling operation is completed, the upper plate edge supporting rods are removed and the plates fall alternately out of the rack into a uniformally stacked pile which is ready for shipment or the next operation.

4 Claims, 3 Drawing Figures

AUTOMATIC UNLOADING METAL PICKLING RACK

This invention consists generally of a rack used in the handling of metal parts during their fabrication process, and particularly of a rack for handling sheet metal plates for pickling purposes.

One of the primary stages in the manufacture of various products from sheet metal, such as steel, consists of cleaning the sheets by removing any oxides or any other foreign materials which usually adhere to the sheet metal surfaces. This cleaning process is known as "pickling" and it consists of submerging the steel sheets in a bath of sulphuric acid or similar liquid, for the period of time which is required to remove these oxides, etc.

The next steps, immediately following the pickling, consists of rinsing away the acid or any other pickling medium, from the pickled sheets, and stacking these sheets for delivery to the next manufacturing operation. This, of course, requires a great deal of handling, and consequently, handling problems such as excessive weight, proper and complete coverage of the plates on all sides by the pickling medium, proper and complete rinsing away of the pickling medium, drying, and stacking of the plates. It can be seen from the above description, that although the pickling operation in itself is quite simple, the handling of the plates becomes a costly and time consuming operation, fraught with a certain amount of danger to personnel from the corrosive properties of the acids.

It is therefore the primary object of this invention to provide a rack for efficiently pickling, rinsing, drying, and stacking of sheet metal plates, with a minimum of handling, and without direct contact of personnel with the acid or acid covered plates.

This is accomplished in the invention by providing a pickling rack for sheet metal plates, in which the only manual operation required is the original loading of the plates into the rack before the rack is dipped into the acid.

Figure 1:
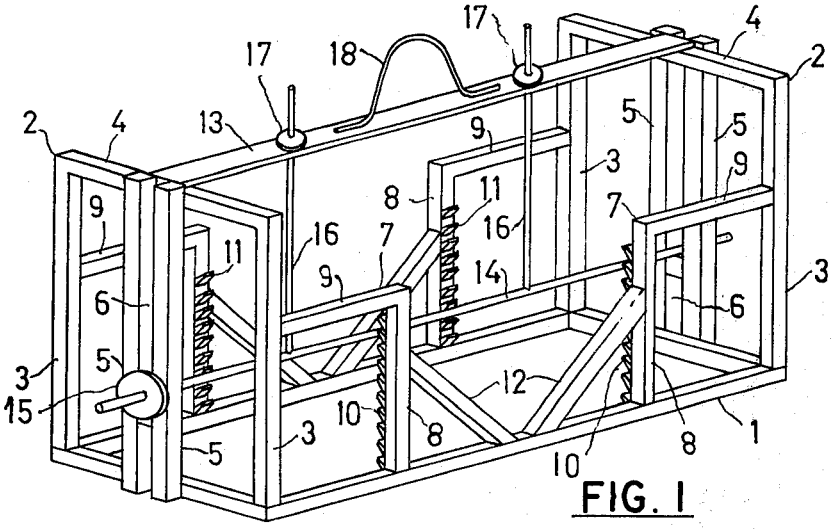
Figure 2:
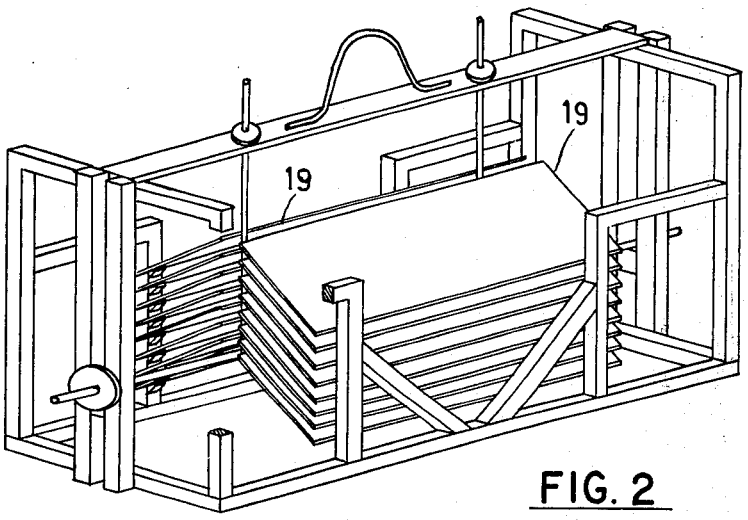
Figure 3:
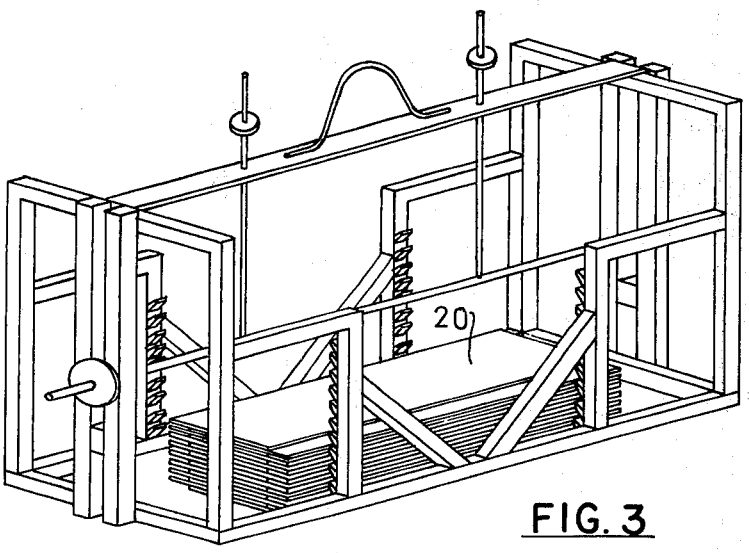

In describing the invention reference will be made to the attached drawings in which, FIG. 1 is an isometric view of the invention showing the various components, FIG. 2 is the same isometric view as shown in FIG. 1 with some of the parts cut away to show the loading of the plates therein prior to pickling, and FIG. 3 shows the same view as in FIG. 1 with the plates released from the rack and stacked, after the completed pickling operation.

In the drawings, the rack which is preferably made up of bars having a square cross-section consists of an elongated rectangular base 1 which is generally larger than the plates to be handled in the rack. Extending vertically from each end of the base 1 is an open wall 2 made of two side bars 3,3, each bar being attached to a corner of said base, and each pair of side bars 3 being connected to each other at the top with a horizontal bar 4.

Centrally located on each of the sides 2,2, is a pair of spaced vertical bars 5,5, having a narrow space 6 between them. A vertical open side wall 7, which is somewhat shorter than the end walls 2, runs part way up the long side of the base 1. The wall 7 is formed by bar 3 to which it is attached, a bar 8 spaced from the bar 3, and a horizontal bar 9 forming the top of said side wall.

Each of the bars 8, on one side of the base 1 is provided with a set of notches 10, while each of the bars 8 on the opposite side of the base are provided with similar notches 11. Each set of notches on one side of the base is located alternately to the set of notches on the opposite side of the base 1, so that a notch 10 is located a half space higher or lower than the corresponding notch 11, on the opposite side of the base. The walls 7 are reinforced by knee braces 12.

The end walls 2,2, are joined at their top by a centrally located flat bar 13, which is provided with a loop 18 at its center by means of which the rack can be lifted by hand, by crane, or conveyor hook, as required.

Two spaced rods 16,16, pass freely through holes in the bar 13, and extend downwardly into the rack. The bottom ends of the rods 16,16, are joined by means of a horizontal bar 14, the ends of which extend beyond the walls 2,2, and these extended ends pass through the spaces 6,6. A washer 15 is permanently attached to the ends of the rod 14 on the outside of the bars 5,5, to keep the rod 15 sliding freely in the spaces 6,6, without slipping out of these spaces. Washers 17 are attached to the upper ends of the rods 16 to keep said rods suspended within the rack at a required location.

As shown in FIG. 2, the steel plates 19, which are to be pickled, are loaded into the rack by placing the lower edge of a plate into a pair of lined up notches 10,10, on one side of the rack, and having the upper edge of the steel plate leaning against and supported by the rods 16,16. Similarly, the plates are loaded into the notches 11,11, in the opposite side of the rack. The notches 10 and 11 being staggered in relation to each other, as described above, cause the plates 19 to be spaced and stacked alternately within the rack.

At this stage the rack is lowered into the pickling acid, removed from the acid, drained and lowered into the rinse, then drained and dried. When the plates 19 are ready to be removed from the rack, the rods 16,16, are raised so that each plate 19, starting with the lowest and going up, looses its upper support, and therefore falls out of the rack. Due to the particular spacing of the notches 10 and 11, the plates 19 stack up alternately into a uniform pile 20 upon the surface upon which the rack rests. The rack is then removed and the stacked plates are ready to be taken to the next operation, or for shipment.

Of course, since the entire rack is submerged in the pickling acid, all its components are made of an acid resisting metal, or the metal used in its construction is covered with an acid resisting coating.

Also, experimentation has shown that the enclosed angle at the top of and between the two inclined piles of plates should not be less than 90°, for the proper functioning of the rack.

From the above description it can be seen that the only manual operation involved in so far as the pickling operation is concerned, consists of the loading of the plates into the rack, indicating clearly the economic and safety advantages of the invention.

Having described the invention, what I claim is:

1. A rack for holding metal plates which are to go through a pickling process by being submerged in an oxide and dirt removing acid, comprising a framework having an open rectangular base, two opposite open rectangular end walls, which are joined together by a centrally located flat bar at their tops, a plurality of straight rods which pass freely through holes in said flat bar and are suspended into the rack from it, said straight rods being joined together at their lower ends by a horizontal bar, the ends of which pass through two spaced, parallel, vertical guide bars centrally located in said end wall; two spaced open side walls located on each side of said base abutting but shorter than said end walls; a series of evenly spaced notches in the inner framework of said side walls for supporting the lower edge of plates placed within the rack, these notches in one side of the rack being alternately located in relation to the notches in the opposite side of the rack; the upper edges of said plates leaning towards, and being supported by said removable rods; and a centrally located handle or loop attached to said central flat bar, by means of which the rack can be lifted.

2. A rack such as described in claim 1 which is constructed of metal bars of an acid resisting metal.

3. A rack such as described in claim 1 which is constructed of metal bars which are coated with an acid resisting material.

4. A rack such as described in claim 1 in which the converging piles of contained plates do not form an enclosed angle at their tops which is less than 90°.

* * * * *